US011318533B2

(12) United States Patent
Tiller et al.

(10) Patent No.: US 11,318,533 B2
(45) Date of Patent: May 3, 2022

(54) METHOD FOR PRODUCING A GREEN COMPACT USING A PRESSING TOOL, A PRESSING TOOL, A GREEN COMPACT, AND A SINTERED PART

(71) Applicant: GKN SINTER METALS ENGINEERING GMBH, Radevormwald (DE)

(72) Inventors: Stefan Tiller, Sankt Augustin (DE); Rainer Schmitt, Wachtberg (DE); Nils Bornemann, Bonn (DE)

(73) Assignee: GKN Sinter Metals Engineering GmbH, Radevormwald (DE)

( * ) Notice: Subject to any disclaimer, the term of this patent is extended or adjusted under 35 U.S.C. 154(b) by 126 days.

(21) Appl. No.: 16/494,554

(22) PCT Filed: Mar. 14, 2018

(86) PCT No.: PCT/EP2018/056349
§ 371 (c)(1),
(2) Date: Sep. 16, 2019

(87) PCT Pub. No.: WO2018/167127
PCT Pub. Date: Sep. 20, 2018

(65) Prior Publication Data

US 2020/0009652 A1 Jan. 9, 2020

(30) Foreign Application Priority Data

Mar. 14, 2017 (DE) ..... 10 2017 105 364.6

(51) Int. Cl.
*B22F 3/03* (2006.01)
*B28B 3/08* (2006.01)
(Continued)

(52) U.S. Cl.
CPC ..... *B22F 3/03* (2013.01); *B28B 3/086* (2013.01); *B30B 11/007* (2013.01); *B30B 15/022* (2013.01); *B22F 2003/031* (2013.01)

(58) Field of Classification Search
None
See application file for complete search history.

(56) References Cited

U.S. PATENT DOCUMENTS 7,641,827 B2 1/2010 Menzel et al.
2013/0039798 A1 2/2013 Satran et al.

FOREIGN PATENT DOCUMENTS

CN 104368811 A 2/2015
DE 29500253 U1 6/1996
(Continued)

OTHER PUBLICATIONS

Japan Patent Office, Notice of Reasons for Rejection, Application No. 2019-550250, dated Dec. 1, 2020, 12 pages.

*Primary Examiner* — Adam Krupicka
(74) *Attorney, Agent, or Firm* — Quarles & Brady LLP

(57) ABSTRACT

A method for producing a green compact uses a pressing tool including a die, a first punch to be displaced in an axial direction, a second punch to be displaced in a radial direction through a channel in the die and a receptacle having a filling opening. The method includes locating the second punch before or during filling of a powdery material into the receptacle so as to be outwardly offset in the radial direction relative to an inner peripheral surface, filling the powdery material into the receptacle, and moving at least the first punch and the second punch and compressing the material in the receptacle, with the second punch being moved in the radial direction toward the receptacle only so far that it is
(Continued)

disposed flush with a region of the inner peripheral surface. A pressing tool, a green compact and a sintered part are also provided.

16 Claims, 3 Drawing Sheets

(51) Int. Cl.
*B30B 11/00* (2006.01)
*B30B 15/02* (2006.01)

(56) References Cited

FOREIGN PATENT DOCUMENTS

| | | | |
|---|---|---|---|
| DE | 20115860 | U1 | 1/2002 |
| DE | 102005038915 | A1 | 3/2007 |
| DE | 102010048183 | A1 | 4/2012 |
| DE | 102013204370 | A1 | 9/2013 |
| EP | 2098317 | A1 | 9/2009 |
| JP | H07266091 | A | 10/1995 |
| JP | H11300497 | A | 11/1999 |

METHOD FOR PRODUCING A GREEN COMPACT USING A PRESSING TOOL, A PRESSING TOOL, A GREEN COMPACT, AND A SINTERED PART

BACKGROUND OF THE INVENTION

Field of the Invention

The invention relates to a method for producing a green compact using a pressing tool, a pressing tool, a green compact, and a sintered part (or a component produced by a heat treatment of the green compact, also referred to below as a sintered part). In particular, the pressing tool is used to produce sinterable green compacts or any other green compacts that are to be further processed (e.g., by means of a heat treatment), i.e., green compacts that can be sintered after the pressing process. In particular, metallic and/or ceramic powders can be pressed into green compacts in the die. In particular, the method can be used to operate the pressing tool and to produce the green compact or the sintered part. In particular, the pressing tool can be used to produce the green compact.

A die extends along an axial direction between a first end face and a second end face and forms between the end faces an inner peripheral surface that forms a receptacle for a powdery material or for a green compact produced from the material by compression. At least one punch of the pressing tool that can be moved along the axial direction via a (first) end face into the die is provided which compresses the material that is arranged in the receptacle into the green compact. It is of course also known to use additional punches that can be moved along the axial direction and penetrate into the die via the other (second) end face.

In order to produce a geometric undercut in the green compact, an opening can be provided in the inner peripheral surface via which at least one second punch that can be moved along a radial direction through a channel in the die and toward the receptacle, thereby filling the opening, can be moved into the receptacle.

On the one hand, the inner peripheral surface of the die forms the receptacle for the powder or the green compact to be produced. In particular, at least one upper punch of the pressing tool can travel into the die along the axial direction via the upwardly open first end face of the die. The at least one upper punch slides along the inner peripheral surface of the die and increasingly compresses the powder. In particular, at least one lower punch can be additionally provided which moves into the die via a downwardly open second end face of the die along the axial direction, or moves in the die between an upper position and a lower position, it also being possible for the die to be moved relative to the optionally unmoved lower punch. The powder is thus pressed into a green compact between the at least one upper punch and the at least one lower punch, the inner peripheral surface of the die particularly defining a lateral contour of the green compact.

The green compacts produced in dies can have a variety of geometries. However, it has hitherto proven difficult to produce green compacts that taper at least in portions of the green compact along the axial direction. Particularly in portions of the green compact having side surfaces that are inclined relative to the axial direction—i.e., that taper conically—, inhomogeneities can occur in the density distribution of the green compact. Therefore, these parts either cannot be produced or do not have the desired strength or the desired properties particularly in these portions, even as sintered parts. Up to now, no method of compression is known with which such geometries can be produced with reasonable effort and/or with optimal component properties.

SUMMARY OF THE INVENTION

Proceeding from this background, it is an object of the present invention to at least partially solve the problems described with reference to the prior art. In particular, even geometries of green compacts to be produced that are especially challenging are to be able to be produced by means of a method and/or by means of a pressing tool, it being possible for inhomogeneities in the density of the green compact to be reduced or prevented.

To achieve this object, the invention proposes a method, a pressing tool according, a green compact, and a sintered part as described below. Advantageous developments are the subject of the dependent claims. The features listed individually in the claims can be combined in a technologically meaningful manner and supplemented by explanatory facts from the description and details of the figures, with additional design variants of the invention being indicated.

A method for producing at least one green compact with a pressing tool makes a contribution in this regard. The pressing tool comprises at least one die, one first punch, and one second punch. The die extends along an axial direction between a first end face and a second end face and forms an inner peripheral surface with an opening between the end faces. The inner peripheral surface forms a receptacle for the green compact. The at least one first punch can be moved over one of the end faces of the die into the receptacle along an axial direction. The at least one second punch can be moved through a channel in the die and toward the receptacle along a radial direction and preferably fills the opening (once it has been moved to the receptacle). The method comprises at least the following steps:

a) providing the die and the second punch, the second punch being arranged before or during step b) so as to be outwardly offset in the radial direction with respect to the inner peripheral surface (and the opening);
b) filling a powdery material into the receptacle;
c) moving at least the (at least one) first punch and the (at least one) second punch and compressing the material in the receptacle, the (at least one) second punch being moved in the radial direction toward the receptacle only so far that it is arranged at least with a region of the inner peripheral surface that moves along the axial direction between one end face via which the (at least one) first punch is moved into the receptacle and the opening,
   so as to be flush or
   so as to protrude into the receptacle by no more than 0.1 mm [millimeters], particularly by no more than 0.05 mm, at least relative to this region of the inner peripheral surface in the radial direction.

The second punch, which can be moved in the radial direction, is particularly not used to produce an undercut. In order to produce an undercut, the second punch is moved beyond the opening into the receptacle and must be moved out of the receptacle before the removal of the green compact from the receptacle, so that the form locking produced in the axial direction between second punch and green compact is eliminated. Such a "return movement" of the second punch is not required for the removal of the green compact from the receptacle; rather, the green compact can also be removed, in particular, when the second punch is in the abovementioned "flush" or "slightly protruding" end position. In particular, the second punch for removing the green compact is moved back along the radial direction by no more than 0.1 mm relative to the end position (i.e., the position in which the second punch is moved farthest toward the receptacle during step c) along the radial direction).

A compaction of the powdery material is thus achieved with the second punch through a compression in the radial direction. For this purpose, it is permitted that the powdery material enter the channel via the opening. In that way, an additional amount of material can be transported into this region of the eventual green compact, this additional amount being supplied through the second punch via the opening of the receptacle and thus fed to the green compact. A transporting of the powdery material along the axial direction by the first punch during compression is thus (partially) replaced and/or supplemented here through the transporting of the powdery material along the radial direction.

Particularly in the case of tapered components with tapered side walls, for example, the powdery material cannot be displaced with sufficient accuracy and/or only with high risk of inhomogeneities in this portion of the later green compact. The use of a second punch that can be moved in the radial direction now enables the required amount of material to be moved toward this portion in a targeted and precisely measured manner.

This makes it possible to produce green compacts having a very high and/or very uniform density throughout their cross section.

Particularly, in the specified end position, the second punch has an end face that forms the receptacle together with the inner peripheral surface, with the end face extending parallel to the axial direction. Preferably, the inner peripheral surface extends parallel to the axial direction, particularly in the region between the opening and the first end face of the die. A "parallel" orientation should still be present here, insofar as this can usually be adjusted with the manufacturing tolerances of the components specified here, so that deviations of no more than two (2) angular degrees, preferably of no more than one (1) angular degree, especially preferably of no more than 0.3 angle degrees from the axial direction should also be included.

In particular, the (at least one) second punch is offset in step a) or during step b) so far in the radial direction relative to the inner peripheral surface that the material filled in step b) (before step c)) is also disposed in the channel.

Preferably, the filling of the material and the moving of the second punch are carried out at least partially parallel to each other. In particular, the second die is arranged so as to be substantially flush with the inner peripheral surface before the material is introduced, with the second punch being retracted along the radial direction during the filling of the material. The movement of the second punch acts like a vacuum pump and pulls the material into the channel.

In particular, the material arranged in the channel is displaced via the opening into the receptacle as a result of the movement of the (at least one) second punch in step c).

Preferably, the (at least one) second punch comprises at least one first punch part and one second punch part that can be moved independently of one another. It is also possible for two second punches to be provided. This enables the method to be adapted more closely to the prevailing conditions. For example, partial volumes of the later green compact can be successively filled and compacted.

In particular, all of punches (and ejectors) that are provided in the method can be coupled together or moved and controlled completely independently of one another.

In particular, the punch parts are arranged next to one another along the axial direction. A different arrangement of the punch parts is also possible, however. These can also be arranged coaxially with one another or next to one another along a peripheral direction.

In particular, a subregion of a wall region of the green compact extending along the axial direction from a first end to a second end is compacted in step c) by the (at least one) second punch, the subregion being arranged so as to be spaced apart from the first end and/or from the second end. The wall region between the first end and the subregion is compressed in particular by the first punch. In this region, the powdery material is displaced along the inner peripheral surface primarily along the axial direction. The wall region extends from a first end to a second end of the wall region or green compact, it not being necessary for the ends to define the maximum extent of the green compact along the axial direction. In step c), a subregion of the wall region is compacted by the second punch. The subregion here is the region of the green compact that is arranged in the radial direction in front of the end face of the second punch.

In particular, the subregion extends along the axial direction between a first parting line and a second parting line on or to the wall region, with at least one of the parting lines having a curved, particularly meandering, shape. For one thing, due to the minimal offset of the subregion in the radial direction, these parting lines can be generated relative to the wall regions that are not compressed in the radial direction and can therefore be readily identifiable. For another, a different surface pattern and/or another second surface texture is formed in the subregion that is visually distinguishable from the first surface texture of the wall region outside of the subregion.

Preferably, the (at least one) second die is disposed on a portion of the green compact that tapers along the axial direction, with a ratio between a largest cross section transverse to the axial direction of the portion and a smallest cross section being at least 2:1, preferably at least 3:1. The largest cross section of the tapered portion is arranged particularly between the first parting line and the second parting line. Preferably, the smallest cross section is also arranged between the first parting line and the second parting line.

In particular, the tapering occurs continuously over side surfaces of the inner peripheral surface and/or of the receptacle that are arranged so as to be inclined relative to the axial direction.

A pressing tool for producing at least one green compact is also proposed. The pressing tool can be used particularly for the proposed method for producing a green compact. The pressing tool comprises at least one die, at least one first punch, and at least one second punch. The die extends along an axial direction between a first end face and a second end face and forms an inner peripheral surface with an opening between the end faces. The inner peripheral surface forms a receptacle for the green compact. The at least one first punch can be moved along an axial direction. The at least one second punch can be moved along a radial direction through a channel in the die and toward the receptacle while filling the opening (once it has been moved to the receptacle). The first punch can be moved over one of the end faces of the die into the receptacle along the axial direction. The pressing tool is now configured such that the second punch can be moved in the radial direction only so far toward the receptacle that it can be arranged at least with a region of the inner peripheral surface that is arranged between one end face, via which the first punch is moved into the receptacle, and the opening so as to be flush or protrude into the receptacle by no more than 0.1 mm [millimeters], particularly by no more than 0.05 mm [millimeters] at least relative to this region of the inner peripheral surface in the radial direction.

In particular, the second punch has no contour on its end face facing toward the receptacle for forming an undercut on the green compact. The term "undercut" preferably denotes an offset in the outer surface of the green compact that is undersized (along the radial direction) by more than 2 or 1 mm, or even by more than just 0.1 mm [millimeters], particularly by more than 0.05 mm, relative to every (other) surface of the green compact between the surface of the green compact that is formed by the end face of the second punch and the first end and/or the second end of the wall region or of the green compact along the axial direction.

In particular, the first end and the second end are each arranged directly adjacent to the wall region.

In particular, the (at least one) second punch has an end face that forms the receptacle together with the inner peripheral surface, with the end face extending parallel to the axial direction.

Preferably, the inner peripheral surface extends parallel to the axial direction, particularly in the region between the opening and the first end face of the die.

The remarks regarding the method described above apply in like manner to the pressing tool, and vice versa.

A green compact is proposed that is produced through compression of a powdery material, the green compact having a longitudinal axis that extends along an axial direction and a wall region that extends parallel to the longitudinal axis and along the axial direction from a first end to a second end. The wall region comprises a subregion that is arranged so as to be spaced apart from the first end and the second end. A first surface texture of the wall region outside the subregion created through compression is different from a second surface texture of the subregion.

In particular, the first surface texture outside the subregion is produced by shearing, namely through movement of the particles in the axial direction along the inner peripheral surface during compression, thus forming a glossy surface with flattened particles.

In particular, the subregion extends along the axial direction between a first parting line to the wall region and a second parting line to the wall region, the parting line forming the transition from the first surface texture to the second surface texture.

The subregion of the wall region is formed as a result of the compression with the second punch along the radial direction. As a result of the radial compression, a second surface texture is created in the subregion that is already visually distinguishable from the first surface texture (outside the subregion).

The second surface texture of the subregion is specifically not formed by shearing. Here, the particles are compressed along the radial direction. The result is a matte surface with flattened particles.

According to a preferred embodiment, at least one (in particular both) of the parting lines has a curved, in particular meandering shape. A "curved" shape of a parting line is present if it is not rectilinear, i.e., if the parting line has at least one radius of curvature. If the shape has a plurality of portions with different radii of curvature, particularly different (opposing) orientations relative to the course of the parting line, then a meandering shape can be assumed to exist. The curved or meandering shape counteracts the formation of a predetermined breaking point, which is rather to be expected with rectilinear parting lines. This predetermined breaking point of the green compact is caused particularly by the fact that the transition between the subregion compacted by the second punch and the wall region formed by the axial compression is present in the vicinity of the parting line. These minimal edges and/or textural differences that may be present there can form the predetermined breaking point. This transition of a possible difference in density in the green compact between the subregion and the wall region is "blurred" by the curved parting line.

In particular, the subregion is made without undercuts to the wall region and ends flush with the wall region or is offset into the green compact by no more than 0.1 mm [millimeters], particularly no more than 0.05 mm, relative to the wall region in a radial direction. The term "undercut" preferably denotes any shape of the green compact that is undersized (along the radial direction) by more than 0.1 mm, particularly by no more than 0.05 mm, relative to every surface of the green compact between the subregion of the green compact that is formed by the end face of the second punch and the first end and/or the second end of the wall region or of the green compact along the axial direction.

Particularly, the subregion is disposed on a portion of the green compact that tapers along the axial direction, with a ratio between a largest cross section transverse to the axial direction of the portion and a smallest cross section being at least 2:1, particularly at least 3:1.

The largest cross section of the tapered portion is arranged particularly between the first parting line and the second parting line. Preferably, the smallest cross section is also arranged between the first parting line and the second parting line.

In particular, the tapering occurs continuously over side surfaces of the portion of the green compact that are arranged so as to be inclined relative to the axial direction, with at least the side surface of the green compact having the subregion extending parallel to the longitudinal axis at least in the subregion.

The green compact can be produced particularly by means of the method and/or by using the pressing tool. The remarks regarding the method and the pressing tool apply in like manner to the green compact, and vice versa.

Furthermore, a sintered part or a heat-treated component (hereinafter called "sintered part") is proposed which is produced through sintering or heat treatment of the above-described green compact, the sintered part having a third surface texture being embodied in the region of the green compact in which the first surface texture was previously present, and a fourth surface texture (that is different from the third surface texture) in the region of the green compact in which the second surface texture was present.

The third surface texture and the fourth surface texture are affected by the changes in the surface texture as a result of the sintering or the heat treatment starting from the surface texture of the green compact. The differences in the surface texture between the subregion and the wall region can also be identified on the sintered part.

The remarks regarding the green compact apply in like manner to the sintered part, and vice versa.

By way of precaution, it should be noted that the number words used here ("first," "second," . . . ) serve primarily (only) to distinguish a plurality of similar objects or quantities; that is, they do not prescribe any dependency and/or order of these objects or quantities relative to one another. Should a dependency and/or order be required, this is explicitly stated herein or it obviously follows for a person skilled in the art when studying the embodiment specifically described.

The invention and the technical environment will be explained in greater detail with reference to the figures. It should be noted that the invention is not intended to be limited by the embodiments shown. In particular, unless explicitly stated otherwise, it is also possible to extract partial aspects of the features explained in the figures and to combine them with other components and insights from the present description and/or figures. In particular, it should be pointed out that the figures and, in particular, the illustrated proportions are only schematic. Same reference symbols designate same objects, so that explanations of other figures can be consulted where necessary.

DESCRIPTION OF THE INVENTION

Figure 1:
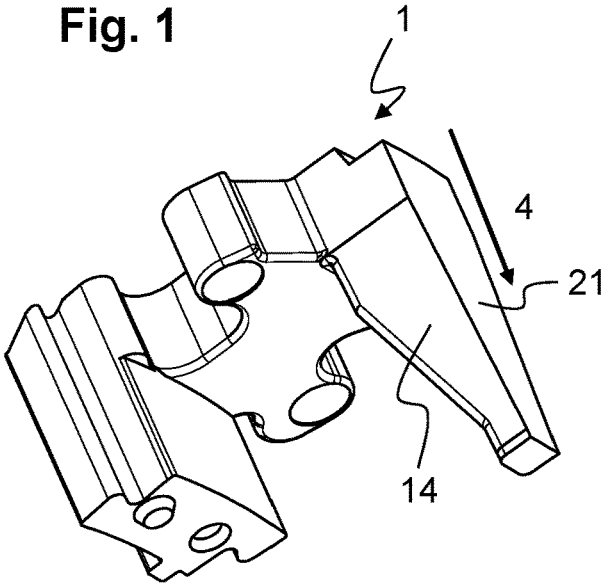
FIG. 1 shows a green compact in a first perspective view.
Figure 2:
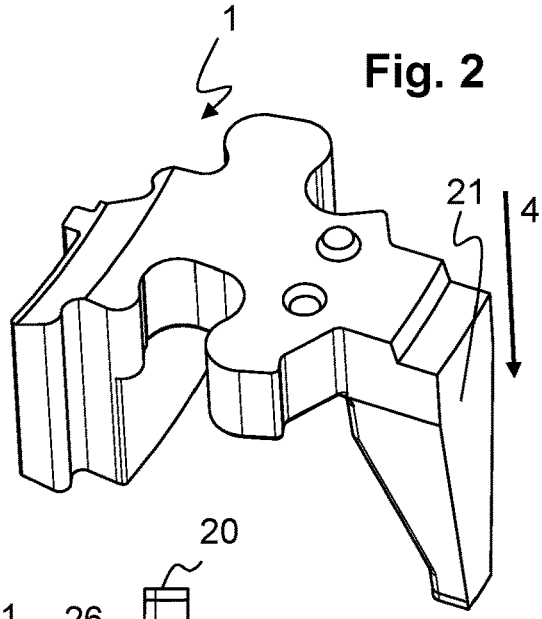
FIG. 2 shows the green compact according to FIG. 1 in a second perspective view.
Figure 3:
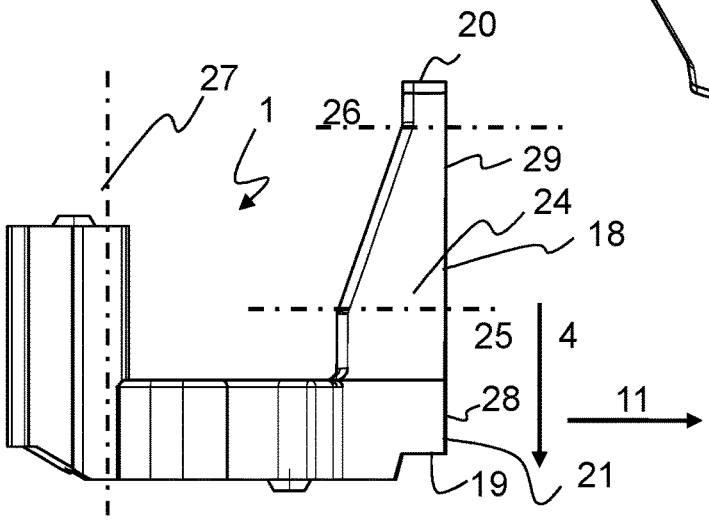
FIG. 3 shows the green compact according to FIGS. 1 and 2 in a side view.

FIG. 1 shows a green compact 1 in a first perspective view. FIG. 2 shows the green compact 1 according to FIG. 1 in a second perspective view. FIG. 3 shows the green compact 1 according to FIGS. 1 and 2 in a side view. FIGS. 1 to 3 are described together below.

The green compacts 1 produced in dies 3 can have a variety of geometries. It has hitherto proven difficult to produce green compacts 1 that taper at least in portions 24 of the green compact 1 along the axial direction 4. Particularly in portions 24 of the green compact 1 having side surfaces that are inclined relative to the axial direction 4—i.e., that taper conically—, inhomogeneities can occur in the density distribution of the green compact 1. Therefore, these parts either cannot be produced or do not have the desired strength or the desired properties particularly in these portions 24, even as sintered parts 30.

The green compact 1 shown here was produced by compressing a powdered material 14. The green compact 1 has a longitudinal axis 27 that extends along an axial direction 4 and a wall region 21 that extends parallel to the longitudinal axis 27 and along the axial direction 4 from a first end 19 to a second end 20, the wall region 21 having a subregion 18 that is arranged so as to be spaced apart from the first end 19 and from the second end 20. A first surface texture 28 of the wall region 21 outside the subregion 18 created through compression is different from a second surface texture 29 of the subregion 18. The subregion 18 of the wall region 21 is formed as a result of the compression with the second punch 13 along the radial direction 11.

It can be seen that the subregion 18 is free of undercuts relative to the wall region 21 and flush with the wall region 21. The term "undercut" denotes any shape of the green compact 1 that is minimally undersized (along the radial direction 11) relative to every surface of the green compact 1 between the subregion 18 of the green compact 1 that is formed by the end face 15 of the second punch 13 and the first end 19 and/or the second end 20 of the wall region 21 or of the green compact 1 along the axial direction 4.

The subregion 18 is disposed on a portion 24 of the green compact 1 that tapers along the axial direction 4, with a ratio between a largest cross section 25 transverse to the axial direction 4 of the portion 24 and a smallest cross section 26 being at least 2:1.

In the green compact 1 that is shown, the tapering of the portion 24 occurs continuously over side surfaces of the portion 24 that are arranged so as to be inclined relative to the axial direction 4; here, only the side surface of the green compact 1 having the subregion 18 extends parallel to the longitudinal axis 27.

Figure 4:
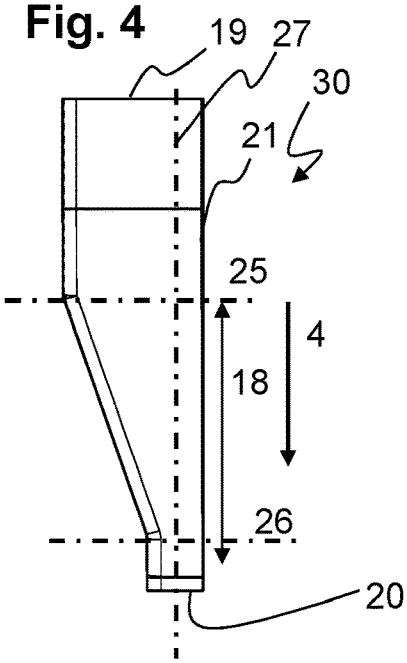
FIG. 4 shows a sintered part in a side view.
Figure 5:
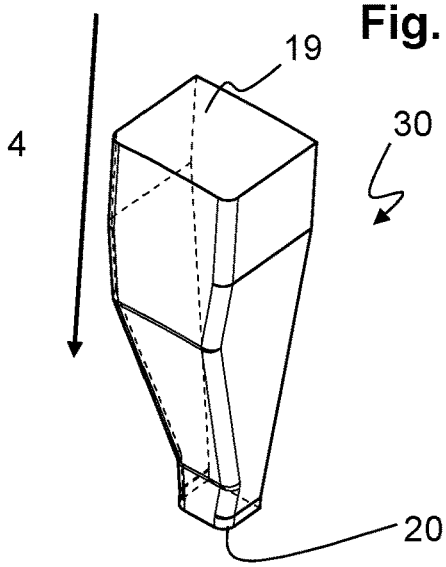
FIG. 5 shows the sintered part according to FIG. 4 in a perspective view.

FIG. 4 shows a sintered part 30 in a side view. FIG. 5 shows the sintered part 30 according to FIG. 4 in a perspective view. FIGS. 4 and 5 are described together below. The sintered part 30 is produced by sintering a green compact 1. The sintered part 30 has a longitudinal axis 27 that extends along an axial direction 4 and a wall region 21 that extends parallel to the longitudinal axis 27 and along the axial direction 4 from a first end 19 to a second end 20, the wall region 21 having a subregion 18 that is arranged so as to be spaced apart from the first end 19 and from the second end 20.

The subregion 18 is disposed on a portion 24 of the sintered part 30 that tapers along the axial direction 4, with a ratio between a largest cross section 25 transverse to the axial direction 4 of the sintered part 30 and a smallest cross section 26 being at least 2:1. In the sintered part 30 that is shown, the taper occurs continuously over side surfaces of the sintered part that are arranged so as to be inclined relative to the axial direction 4. The side surface of the sintered part 30 having the subregion 18, extends parallel to the longitudinal axis 27.

Figure 6:
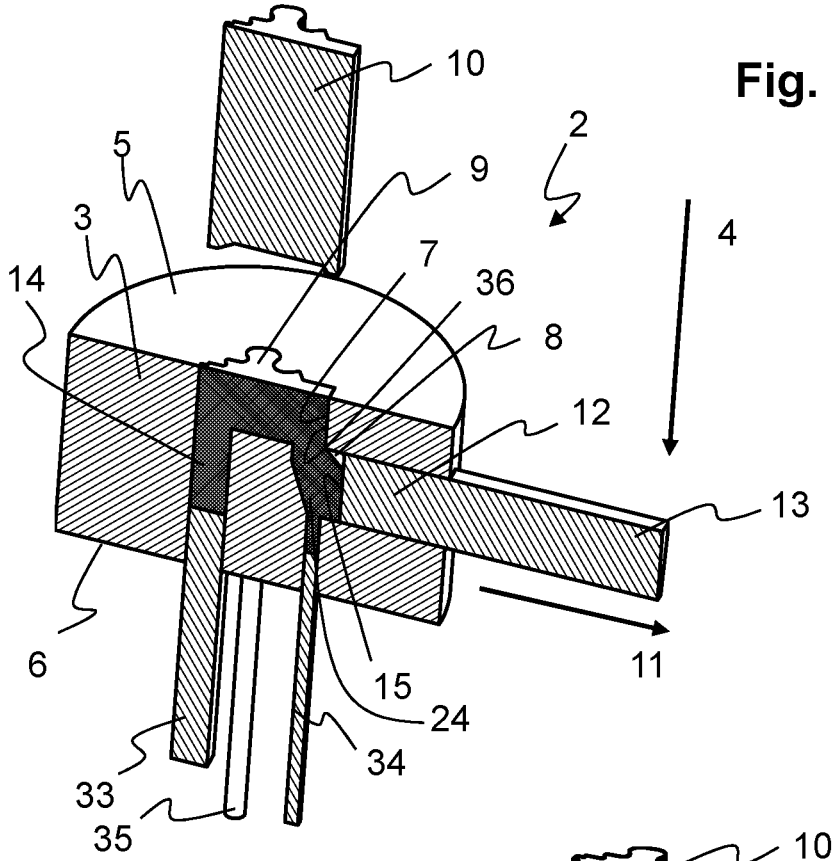
FIG. 6 shows a first pressing tool during step b) of the method in a cutaway perspective view.

FIG. 6 shows a first pressing tool 2 during step b) of the method in a cutaway perspective view. The pressing tool 2 comprises at least one die 3, one first punch 10, and one second punch 13. The die 3 extends along an axial direction 4 between a first end face 5 and a second end face 6 and forms an inner peripheral surface 7 with an opening 8 between the end faces 5, 6. The inner peripheral surface 7 forms a receptacle 9 for the green compact 1. The first punch 10 can be moved along an axial direction 4. The second punch 13 can be moved along a radial direction 11 through a channel 12 in the die and toward the receptacle 9 while filling the opening 8 (once it has been moved to the receptacle 9; see position of the second punch 13 in FIG. 7). The first punch 10 can be moved over the first end face 5 of the die 3 into the receptacle 9 along the axial direction 4. The die 3 and the second punch 13 are provided in step a) of the method, the second punch 13 being offset from the inner peripheral surface 7 (and opposite the opening 8) outward in the radial direction 11 and thereby arranged in the channel 12. The filling of a powdery material 14 into the receptacle 9 takes place in step b) of the method.

As can be seen, the second punch 13, which can be moved in the radial direction 11, is not used to produce an undercut. In order to produce an undercut, the second punch 13 would be moved beyond the opening 8 into the receptacle 9 and would have to be moved out of the receptacle 9 before the removal of the green compact 1 from the receptacle 9, so that the form lock produced in the axial direction 4 between second punch 13 and green compact 1 is eliminated.

Therefore, no undercut is produced here, but rather a compaction of the powdery material 14 through a compression in the radial direction 11. For this purpose, it is permitted that the powdery material 14 enter the channel 14 via the opening 8. It is only in this way that an additional amount of material 14 can be transported into this region of the eventual green compact 1, this additional amount being supplied through the second punch 13 via the of the receptacle 9 and thus fed to the green compact 1 via the opening 8. A transporting of the powdery material 14 along the axial direction 4 by the first punch 10 during compression is thus replaced and/or supplemented here through the transporting of the powdery material 14 along the radial direction 11.

Particularly in the case of tapered components—with conically tapering side walls, for example—the powdery material 14 cannot be moved into this portion 24 of the eventual green compact 1, or only with great difficulty. The use of a second punch 13 that can be moved in the radial direction 11 now enables the required amount of material 14 to be moved toward this portion 24 in a targeted and precise manner.

The second punch 13 has an end face 15 that forms the receptacle 9 together with the inner peripheral surface 7, with the end face 15 extending parallel to the axial direction 4. The inner peripheral surface 7 also extends parallel to the axial direction 4 in the region between the opening 8 and the first end face 5 of the die 3.

In step a), the second punch 13 is offset so far in the radial direction 11 relative to the inner peripheral surface 7 that the material 14 filled in step b) is also disposed in the channel, as shown here. The material 14 arranged in the channel 12 is displaced via the opening 8 into the receptacle 9 as a result of the movement of the second punch 13 in step c).

FIG. 6 also shows a third punch 33, an ejector 34, and another (fourth) punch 35. The third punch 33 and, if applicable, the additional punch 35 are likewise used to compact the powdery material 14. Due to the tapered portion 24, the ejector 34 cannot be used for the compacting of the material 14 (or only to a small extent). This would cause shear stresses in the green compact 1, which can result in the failure of the green compact 1. The ejector 34 is used here exclusively for the purpose of removing the green compact 1 from the die 3 (together with the third punch 33 and the additional punch 35).

Figure 7:
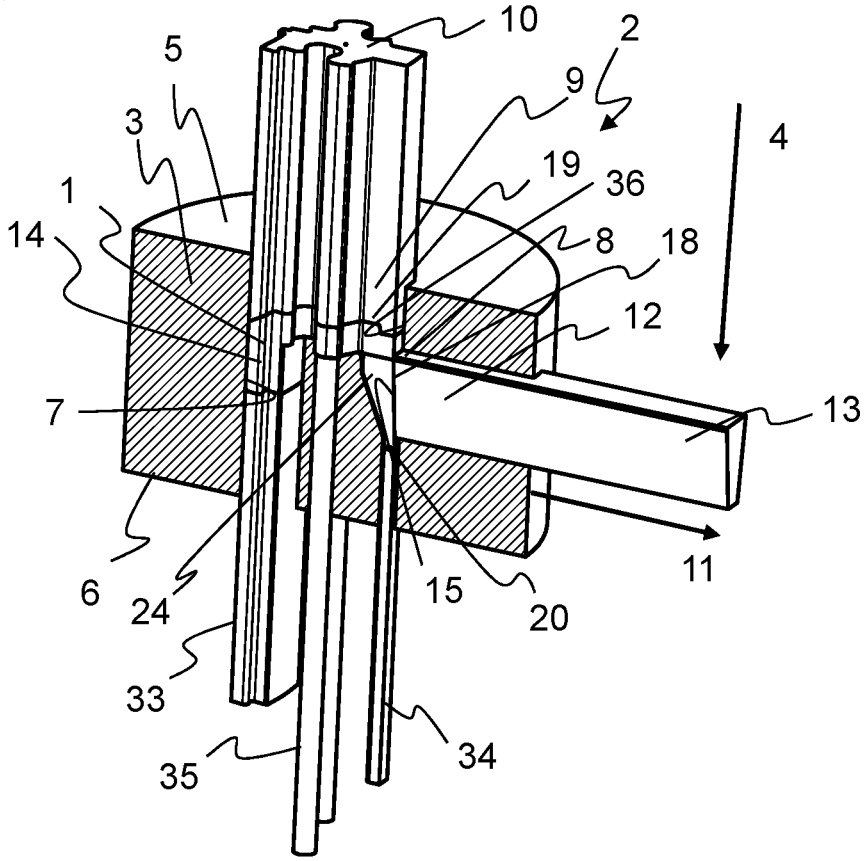
FIG. 7 shows the first pressing tool according to FIG. 6 during step c) in a partially cutaway perspective view.

FIG. 7 shows the first pressing tool 2 according to FIG. 6 during step c) in a partially cutaway perspective view. Reference is made to the remarks in relation to FIG. 6.

In step c) of the method, the first punch 10 and the second punch 13 are moved in the receptacle 9 in order to compress the material 14, the second punch 13 being moved in the radial direction 11 toward the receptacle 9 only so far that it is arranged at least with a region 36 of the inner peripheral surface 7 that moves along the axial direction 4 between the first end face 5 and the opening 8 so as to be flush or so as to protrude into the receptacle 9 by no more than 0.1 mm relative to this region 36 of the inner peripheral surface 7 in the radial direction 11.

A subregion 18 of a wall region 21 of the green compact 1 extending along the axial direction 4 from a first end 19 to a second end 20 is compacted in step c) by the second punch 13, the subregion 18 being arranged so as to be spaced apart from the first end 19 and from the second end 20.

Figure 8:
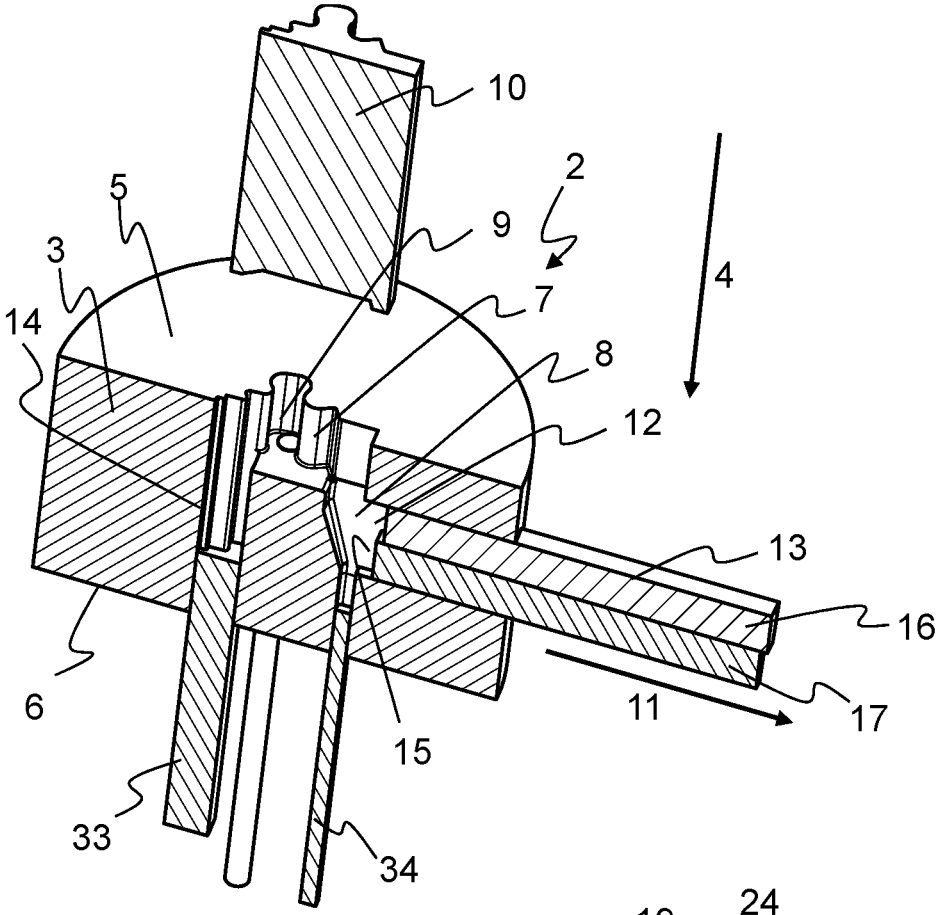
FIG. 8 shows a second pressing tool before step b) of the method in a cutaway perspective view.

FIG. 8 shows a second pressing tool 2 before step b) of the method in a cutaway perspective view. Reference is made to the remarks in relation to FIGS. 6 and 7.

In contrast to the first pressing tool according to FIGS. 6 and 7, the second punch 13 comprises a first punch part 16 and a second punch part 17 that can be moved independently of one another. This enables the method to be adapted more closely to the prevailing conditions. For example, partial volumes of the later green compact 1 can be successively filled and compacted. As can be seen, the punch parts 16, 17 are arranged next to one another along the axial direction 4.

Figure 9:
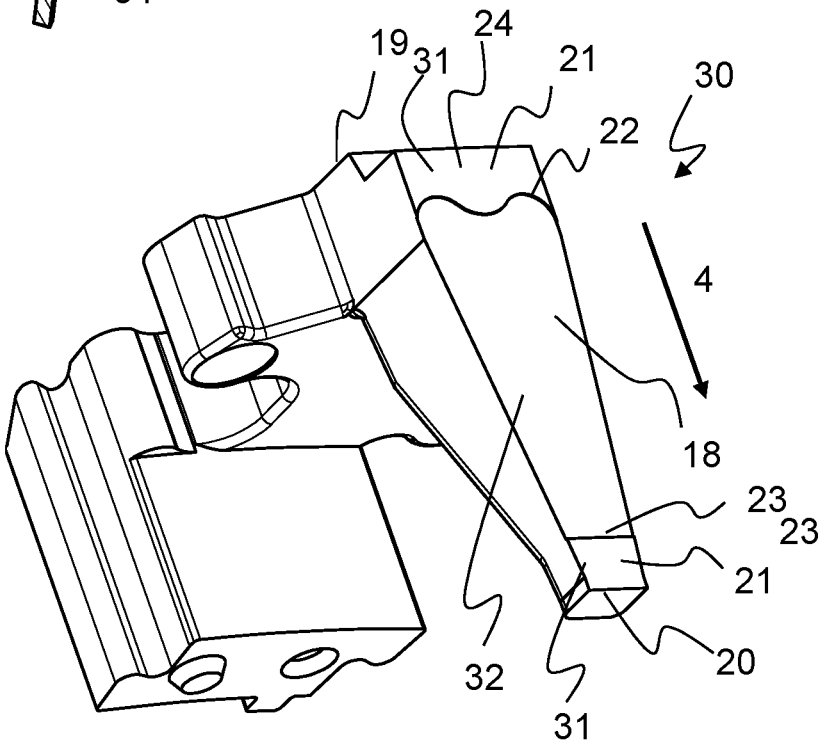
FIG. 9 shows another sintered part in a perspective view.

FIG. 9 shows another sintered part 30 in a perspective view. Reference is made to the remarks in relation to FIGS. 1 to 3. The sintered part 30 was produced by sintering the green compact 1 according to FIGS. 1 to 3.

The subregion 18 of the green compact 1 or of the sintered part extends between a first parting line 22 to the wall region 21 and a second parting line 23 to the wall region 21 along the axial direction 4, with the first parting line 22 having a meandering shape. For one thing, these parting lines 22, 23 are visible due to the minimal offset of the subregion 18 in the radial direction 11 relative to the wall regions 21 that are not compressed in the radial direction 11. For another, a different surface pattern or another fourth surface texture 32 is formed in the subregion 18 that is visually distinguishable from the third surface texture 31 of the wall region 21.

It can be seen here that the largest cross section 25 of the tapered portion 24 is arranged between the first parting line 22 and the second parting line 23. The smallest cross section 26 of the tapered portion 24 is also arranged between the first parting line 22 and the second parting line 23.

LIST OF REFERENCE SYMBOLS

1 green compact
2 pressing tool
3 die
4 axial direction
5 first end face
6 second end face
7 inner peripheral surface
8 opening
9 receptacle
10 first punch
11 radial direction
12 channel
13 second punch
14 material
15 end face
16 first punch part
17 second punch part
18 subregion
19 first end
20 second end
21 wall region
22 first parting line
23 second parting line
24 portion
25 largest cross section
26 smallest cross section
27 longitudinal axis
28 first surface texture
29 second surface texture
30 sintered part
31 third surface texture
32 fourth surface texture
33 third punch
34 ejector
35 additional punch
36 region

The invention claimed is:

1. A green compact produced by compression of a powdery material, the green compact comprising:

a first end and a second end defining an axial direction therebetween;

a longitudinal axis extending along said axial direction;

a wall region extending parallel to said longitudinal axis and along said axial direction from said first end to said second end;

said wall region including a subregion spaced apart from said first end and said second end;

said wall region having a compressed first surface texture outside said subregion; and said subregion having a second surface texture being different from said first surface texture;

wherein said subregion has no undercuts to said wall region and ends flush with said wall region or is offset into the green compact by no more than 0.1 mm relative to said wall region in a radial direction.

2. The green compact according to claim 1, which further comprises first and second parting lines disposed between said subregion and said wall region, said subregion extending along said axial direction between said first and second parting lines, and said first and second parting lines forming a transition from said first surface texture to said second surface texture.

3. The green compact according to claim 2, wherein at least one of said parting lines has a curved shape.

4. The green compact according to claim 1, which further comprises a portion tapering along said axial direction, said portion having a largest cross section and a smallest cross section transverse to said axial direction, said portion having a ratio between said largest cross section and said smallest cross section of at least 2:1, and said subregion being disposed on said portion.

5. A sintered part, comprising:

a heat-treated green compact according to claim 1;

said heat-treated green compact having a third surface texture disposed in a region of said first surface texture; and said heat-treated green compact having a fourth surface texture in a region of said second surface texture.

6. A method for producing the green compact according to claim 1, the method comprising the following steps:

providing a pressing tool including at least one die extending along the axial direction between a first end face and a second end face of the at least one die and forming an inner peripheral surface of the at least one die with an opening between the end faces, the inner peripheral surface forming a receptacle for the green compact, at least one first punch being movable along the axial direction from one of the end faces of the die into the receptacle, and at least one second punch being movable along a radial direction through a channel in the die toward the receptacle, the inner peripheral surface having a region disposed along the axial direction between the one end face, from which the first punch is movable, and the opening;

a) placing the second punch outwardly offset in the radial direction relative to the inner peripheral surface before or during step b);

b) filling a powdery material into the receptacle; and c) moving at least the first punch and the second punch and compressing the material in the receptacle, the second punch being moved in the radial direction toward the receptacle only far enough to be disposed flush with or to protrude into the receptacle by no more than 0.1 mm at least relative to the region of the inner peripheral surface in the radial direction.

7. The method according to claim 6, which further comprises placing the second punch offset in step a) or during step b) so far in the radial direction relative to the inner peripheral surface that the material filled in step b) is also disposed in the channel.

8. The method according to claim 7, which further comprises displacing the material disposed in the channel through the opening into the receptacle as a result of the movement of the second punch in step c).

9. The method according to claim 6, which further comprises providing the second punch with at least one first punch part and at least one second punch part being movable independently of one another.

10. The method according to claim 9, which further comprises placing the punch parts next to one another along the axial direction.

11. The method according to claim 6, which further comprises using the second punch to compact said subregion of said wall region of the green compact extending along the axial direction from said first end to said second end of the wall region in step c), the subregion being spaced apart at least from the first end or from the second end.

12. The method according to claim 6, which further comprises placing the second punch on a portion of the green compact that tapers along the axial direction, and providing a ratio of at least 2:1 between a largest cross section and a smallest cross section of the portion transverse to the axial direction.

13. A green compact produced by compression of a powdery material, the green compact comprising:

a first end and a second end defining an axial direction therebetween;

a longitudinal axis extending along said axial direction;

a wall region extending parallel to said longitudinal axis and along said axial direction from said first end to said second end;

said wall region including a subregion spaced apart from said first end and said second end;

said wall region having a compressed first surface texture outside said subregion;

said subregion having a second surface texture being different from said first surface texture; and first and second parting lines disposed between said subregion and said wall region, said subregion extending along said axial direction between said first and second parting lines, and said first and second parting lines forming a transition from said first surface texture to said second surface texture;

wherein at least one of said parting lines has a curved shape.

14. A sintered part, comprising:

a heat-treated green compact according to claim 13;

said heat-treated green compact having a third surface texture disposed in a region of said first surface texture; and said heat-treated green compact having a fourth surface texture in a region of said second surface texture.

15. A green compact produced by compression of a powdery material, the green compact comprising:

a first end and a second end defining an axial direction therebetween;

a longitudinal axis extending along said axial direction;

a wall region extending parallel to said longitudinal axis and along said axial direction from said first end to said second end;

said wall region including a subregion spaced apart from said first end and said second end;

said wall region having a compressed first surface texture outside said subregion; and said subregion having a second surface texture being different from said first surface texture;

a portion tapering along said axial direction, said portion having a largest cross section and a smallest cross section transverse to said axial direction, said portion having a ratio between said largest cross section and said smallest cross section of at least 2:1, and said subregion being disposed on said portion.

16. A sintered part, comprising:

a heat-treated green compact according to claim 15;

said heat-treated green compact having a third surface texture disposed in a region of said first surface texture; and said heat-treated green compact having a fourth surface texture in a region of said second surface texture.

* * * * *